US008615846B2

(12) United States Patent
Wheeler et al.

(10) Patent No.: US 8,615,846 B2
(45) Date of Patent: Dec. 31, 2013

(54) MECHANICALLY DAMPENING HOLD OPEN ROD

(75) Inventors: Ryan A. Wheeler, Waco, TX (US); Julio Palma, Waco, TX (US); Gary McMurtrey, China Spring, TX (US)

(73) Assignee: Marathonnorco Aerospace, Inc., Waco, TX (US)

( * ) Notice: Subject to any disclaimer, the term of this patent is extended or adjusted under 35 U.S.C. 154(b) by 465 days.

(21) Appl. No.: 12/857,947

(22) Filed: Aug. 17, 2010

(65) Prior Publication Data

US 2010/0307872 A1 Dec. 9, 2010

Related U.S. Application Data

(63) Continuation-in-part of application No. 12/555,200, filed on Sep. 8, 2009, now abandoned, which is a continuation-in-part of application No. 12/135,778, filed on Jun. 9, 2008, now abandoned.

(51) Int. Cl.
*E05F 5/02* (2006.01)

(52) U.S. Cl.
USPC ..... 16/82; 16/49

(58) Field of Classification Search
USPC ..... 16/49, 82, 63, 50, 85, 86 R; 292/338; 188/67
See application file for complete search history.

(56) References Cited

U.S. PATENT DOCUMENTS

| | | | | |
|---|---|---|---|---|
| 1,839,309 | A | 1/1932 | Gundel | |
| 2,245,899 | A | 6/1941 | Campbell | |
| 3,555,591 | A * | 1/1971 | Sogoian | 16/82 |
| 3,765,053 | A * | 10/1973 | Anweiler | 16/82 |
| 3,990,542 | A | 11/1976 | Dent et al. | |
| 4,190,274 | A * | 2/1980 | Gross et al. | 16/82 |
| 4,545,322 | A * | 10/1985 | Yang | 16/85 |
| 4,781,138 | A | 11/1988 | Hay | |
| 5,417,511 | A | 5/1995 | Warden | |
| 6,334,730 | B1 | 1/2002 | Porte | |
| 6,701,578 | B1 | 3/2004 | Lu | |
| 6,728,993 | B1 * | 5/2004 | Murayama | 16/82 |
| 6,966,600 | B2 * | 11/2005 | Moriyama | 16/82 |
| 6,979,046 | B2 * | 12/2005 | Moriyama et al. | 16/82 |
| 7,076,834 | B2 * | 7/2006 | Li | 16/85 |
| 2008/0315058 | A1 | 12/2008 | Zarpellon | |
| 2010/0024161 | A1 | 2/2010 | Wood et al. | |

OTHER PUBLICATIONS

Preliminary Report on Patentability and Written Opinion issued in corresponding International application No. PCT/US2011/048125 on Feb. 19, 2013.

* cited by examiner

*Primary Examiner* — Jeffrey O'Brien
(74) *Attorney, Agent, or Firm* — Baker & Hostetler LLP

(57) ABSTRACT

A hold open rod is provided. The hold open rod includes an outer tube, a lock body connected to the outer tube, an inner tube, slidingly disposed within the outer tube and lock body, the inner tube having an outer surface, and a friction pad captured between the lock body and the outer surface of the inner tube. A method for damping movement of a telescoping rod is also provided. The method includes attaching the locking body to an outer tube, configuring the outer tube and the inner tube to move with respect to each other in a telescoping manner, fitting a damper between an outer diameter of an inner tube and a locking body, and fitting the damper to frictionally engage the outer diameter of the inner tube and the locking body.

9 Claims, 15 Drawing Sheets

MECHANICALLY DAMPENING HOLD OPEN ROD

CROSS-REFERENCE TO RELATED APPLICATIONS

This application is a continuation-in-part (CIP) of application Ser. No. 12/555,200 now abandoned, entitled "Hold Open Rod," filed Sep. 8, 2009 which is a continuation-in-part (CIP) of application Ser. No. 12/135,778 now abandoned, entitled "Device And Method Of Mechanically Dampening A Hold Open Rod," filed on Jun. 9, 2008, the disclosures of which are hereby incorporated by reference in their entirety.

FIELD OF THE INVENTION

The present invention relates generally to rods, struts, etc. More particularly, the present invention relates to a hold open rod.

BACKGROUND OF THE INVENTION

Door closers are used to close a door after being opened manually or automatically. Generally, door closers include a cylinder having a piston connected to a piston rod within the cylinder. The piston is normally biased by a compression spring. The opposed ends of the cylinder and the piston rod may be suitably connected between a door frame and its door. The opening of the door causes the piston to be rectilinearly displaced within the inner surface of the cylinder whereby the connected piston rod is extended beyond the end of the cylinder, thereby compressing the spring. The compression spring, acting on the piston in its compressed state, normally functions to return the door to its closed position as the door is released after the opening of the door.

In certain applications, hold open rods are used to control the rate at which a door, a hatch, etc., closes. To control the closing of a door, pneumatic springs or hydraulic-type dampeners have been used to dampen the movement of hold open rods. The retracting momentum of the piston is typically cushioned by compression of fluid, such as air or oil inside the cylinder tube to create a damping resistance opposite the force that propels the door to close for better control of the speed and force at which the door closes.

A known problem regarding known dampeners is that the fluid used in these devices introduces an opportunity for undesirable leakage. In addition, these hydraulics and pneumatics have seals, wipers and o-rings that wear and require frequent maintenance and replacement.

SUMMARY OF THE INVENTION

In accordance with one embodiment of the invention, a hold open rod is provided. The hold open rod includes an outer tube, a lock body connected to the outer tube, an inner tube, slidingly disposed within the outer tube and lock body, the inner tube having an outer surface, and a friction pad captured between the lock body and the outer surface of the inner tube.

In accordance with yet another embodiment of the invention, a hold open rod may be provided. The hold open rod includes an outer tube, a means for locking connected to the outer tube, an inner tube, slidingly disposed within the outer tube and the means for locking the inner tube having an outer surface, and a means for dampening captured between the means for locking and the outer surface of the inner tube.

In accordance with still another embodiment of the invention, a method for damping movement of a telescoping rod may also be provided. The method may include attaching the locking body to an outer tube, configuring the outer tube and the inner tube to move with respect to each other in a telescoping manner, fitting a damper between an outer diameter of an inner tube and a locking body, and fitting the damper to frictionally engage the outer diameter of the inner tube and the locking body.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 2:
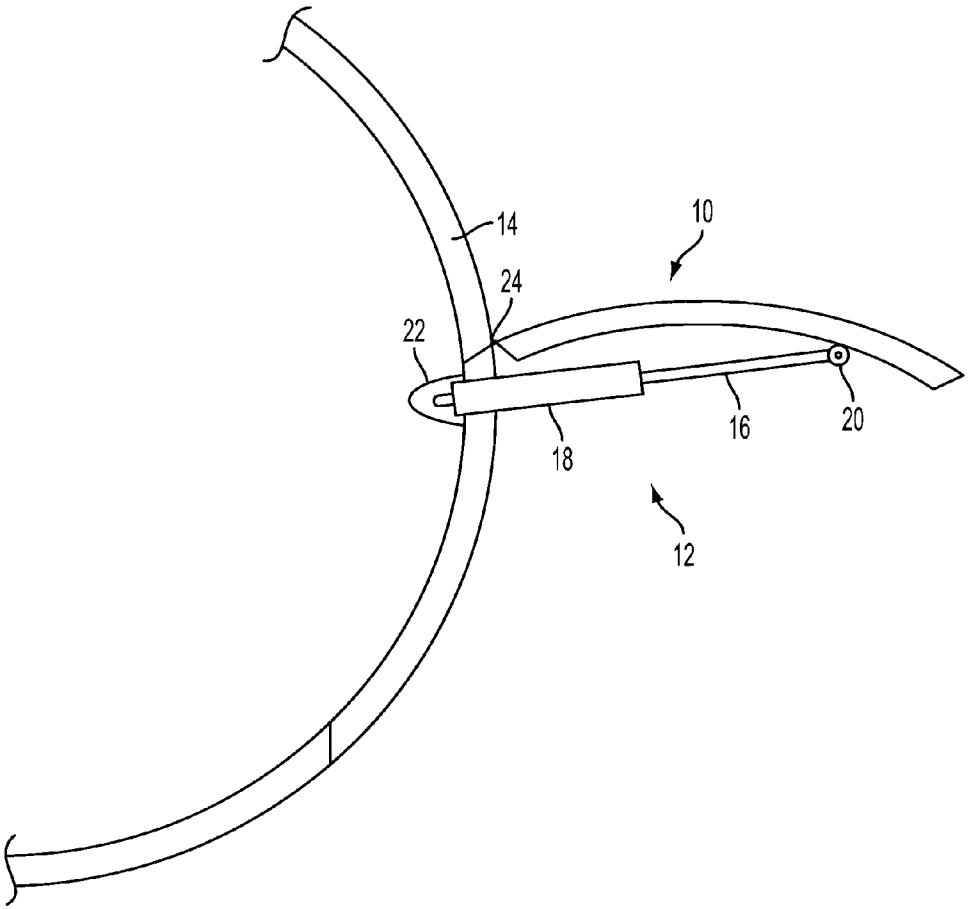
FIG. 2 is a cross-sectional view illustrating the door according to FIG. 1 in an open configuration.

The invention will now be described with reference to the drawing figures, in which like reference numerals refer to like parts throughout.

Figure 1:
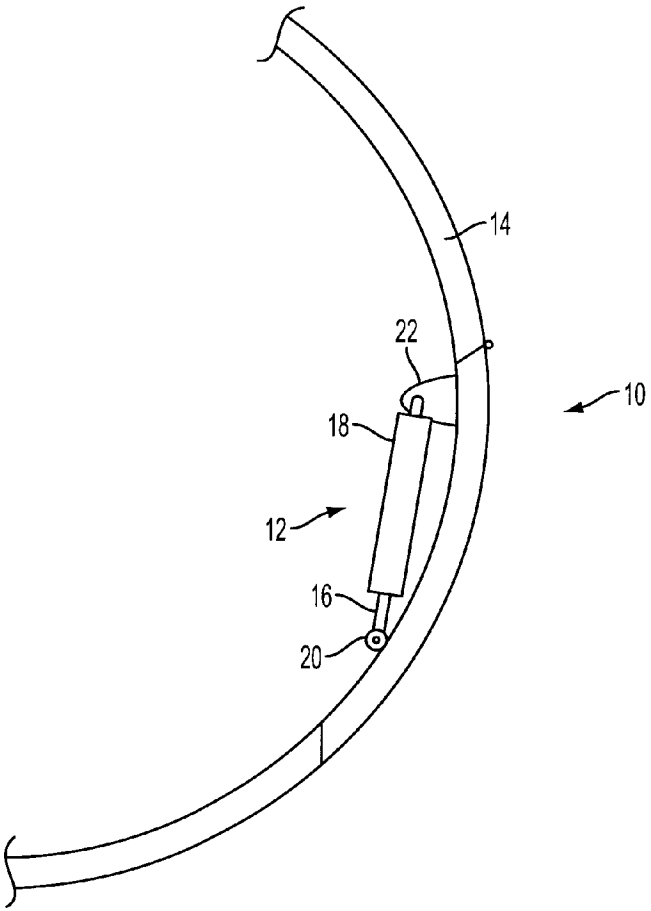
FIG. 1 is a cross-sectional view illustrating a door in a closed configuration suitable for use with a hold open rod according to an embodiment of the invention.

FIG. 1 is a cross-sectional view illustrating a door, hatch, etc., 10 in a closed configuration suitable for use with a hold open rod 12 according to an embodiment of the invention. As shown in FIG. 1, the door 10 may be disposed in a vehicle such as an aircraft, bus, ship, train, or the like. For example, door 10 is disposed in a fuselage of an aircraft. In other examples, the door 10 may be an access panel, cover, cowling, etc., for an engine nacelle, luggage compartment or other such compartment in an aircraft, vehicle, etc. In addition, the hold open rod 12 may be utilized in other structures such as buildings. However, due to the advantageous reduction in weight and ease of maintenance, the hold open rod 12 is particularly useful in aircraft and vehicles. According to a preferred embodiment, hold open rod 12 includes an inner tube 16 and an outer tube 18. Inner tube 16 and outer tube 18 are in axial alignment and slide relative to one another in a telescoping manner.

The hold open rod 12 may be attached to the door 10 by a door fitting 20 pivotally connected to the inner tube 16. The hold open rod 12 may be attached to the fuselage, engine nacelle, etc., by a bracket 22 pivotally connected to the outer tube 18. The converse attachment orientation is also contemplated by the present invention.

As shown in FIG. 2, the door 10, may swing open via a hinge 24, for example. In response to the door 10 being opened, the inner tube 16 may telescope out from the outer tube 18. In the particular example shown, in the open configuration, the door 10 is biased to close at least by gravity acting upon the door 10. In this or other examples, biasing of the door 10 may be provided by a spring or actuator. The hold open rod 12 facilitates maintaining the door 10 in the open configuration by providing resistance. Specifically, the hold open rod 12 provides resistance to the inner tube 16 sliding into the outer tube 18.

While FIGS. 1 and 2 show the hold open rod 12 retracted in response to the door 10 being in a closed configuration and extended in response to the door 10 being in an open configuration, in other examples the hold open rod 12 may be extended in response to the door 10 being closed. That is, depending upon where the hold open rod 12 is attached to the door 10 and/or a frame of the door 10, the bias of the door 10, the addition of any suitable linkage or linkages, the hold open rod 12 may be configured to extend or retract in response to the door 10 being opened or closed.

Figure 3:
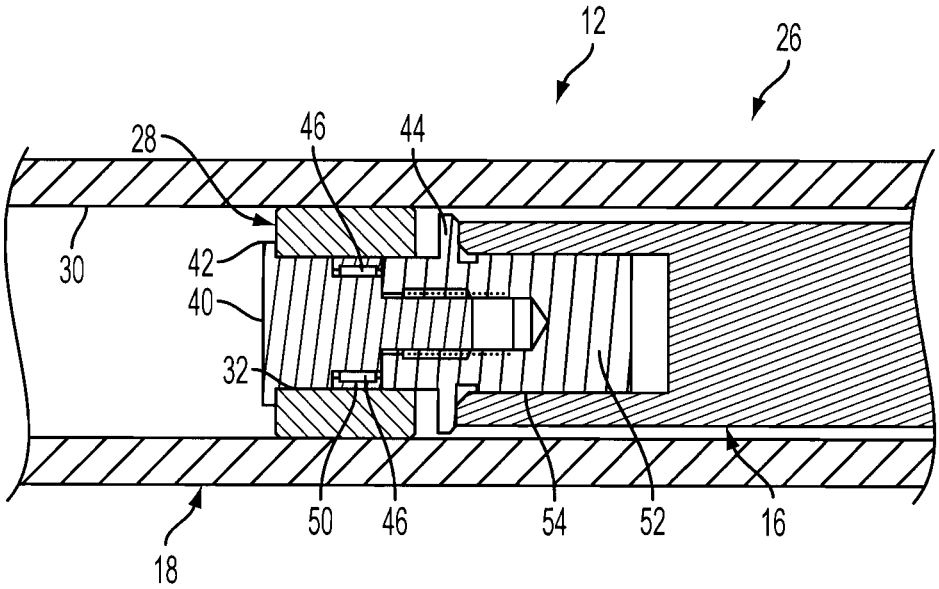
FIG. 3 is a cross-sectional view illustrating a hold open rod according to an embodiment of the invention.

FIG. 3 is a cross-sectional view illustrating a hold open rod 12 according to an embodiment of the invention. One or more friction pads 28 are disposed between an inner surface 30 of the outer tube 18 and an outer surface 32 of the inner tube 16. When the hold open rod 12 is in use, the friction pads 28 are squeezed between the inner surface 30 and the outer surface 32 with sufficient force to generate a predetermined amount of frictional resistance to the sliding motion of the outer tube 18 relative to the inner tube 16. In this manner, movement of the outer tube 18 relative to the inner tube 16 may be dampened or stopped.

The inner tube 16 also includes a head 40 to retain the friction pads 28. The head 40 includes a pair of pad retaining flanges 42 and 44 to retain the friction pads 28 therebetween. The head 40 further includes a pad seat 46. In an embodiment of the invention, the pad seat 46 includes a tapered annular surface that tapers radially outwardly at an angle with respect to the horizontal of FIG. 3. The angle may include any suitable angle such as about 1° to about 7°. In various embodiments, the inner bearing surface of pad seat 46 may be straight, tapered or frusta-conical. In use, as the inner tube 16 is moved in a direction towards the right (relative to FIG. 3) relative to the outer tube 18, friction acting between the friction pads 28 and the inner surface 30 urges the friction pads 28 in direction towards the left relative to the inner tube 16. As the friction pads 28 traverse the pad seat 46 in a direction towards the left, the friction pads 28 are squeezed between the inner surface 30 and the outer surface 32 to a greater extent. Optionally, the friction pads 28 may also be tapered or frusta-conically shaped. For example, the friction pads 28 may also be tapered at an angle. The angle may include any suitable angle such as about 1° to about 7°.

Additionally, the hold open rod 12 may optionally include a spring 50 disposed in a spring retaining seat implemented by a threaded insert 52. If included, the spring 50 may be disposed between the threaded insert 52 and the friction pads 28 to urge the friction pads 28 radially, outwardly. In a particular embodiment, the spring 50 includes an elastomeric annular ring having one or more flange portions that act as resilient members to urge the friction pads 28 radially, outwardly.

In various embodiments of the invention, the head 40 of the inner tube 16 may be removably or threadedly attached to the inner tube 16 via the a threaded insert 52. This allows for the head 40 and the threaded insert 52 to be made from a different material than the inner tube 16. For example, the inner tube 16 may include an aluminum, magnesium, and/or titanium alloy to reduce weight while the head 40 may include a stainless steel and/or bronze alloy to provide wear, strength, and/or machining properties. In some embodiments, a portion of the inner tube 16 may be hollow. This may reduce weight and/or enable the manufacturing and maintenance of the hold open rod 12 to be cost efficient. In other embodiments, however, the inner tube 16 may be one solid piece of material.

In one embodiment, pad seat 46 tapers radially outwardly at an angle. Again, the friction pads 28 may, optionally, also be tapered at an angle, which is based on a variety of factors such as, for example, modulus of elasticity of the friction pads 28, frictional coefficient between the friction pads 28 and the inner surface 30, the frictional coefficient between the friction pads 28 and the outer surface 32, the expected load on the hold open rod 12, the predetermined amount of frictional resistance, empirical data, and the like. For example, the pad seat 46 may taper radially outwardly at both ends or may taper radially inwardly at both ends from about a center portion of the pad seat 46.

In response to the door being opened or closed, the inner tube 16 is moved with respect to the outer tube 18 in a telescoping manner. As the tubes move axially, friction urges the friction pad 28 to translate along the pad seat 46. This translation of the friction pad 28 is again opposed by friction. In a particular example, in response to the inner tube 16 moving in direction "A" with respect to outer tube 18, the friction urges the friction pad 28 to translate along the pad/tube interface. As the friction pad 28 translates along the tapered pad seat 46, a gap or distance separating the inner surface 30 from the outer surface 32 is reduced. The compression of the friction pads 28 provides friction between the friction pads 28 and outer tube 18 inner wall, thereby creating a dampening effect to slow or stop the movement of the telescoping tubes. In general, a transverse load, such as the friction pads 28 being urged outwardly, is produced from an axial force resulting from extending and/or retracting of the hold open rod 12. In a particular example, the dampening effect is sufficient to hold the door 10 (shown in FIGS. 1 and 2) open against the bias of the door 10 but not so great to hamper closing of the door 10 by an operator, for example.

If included, the optional spring 50 may further urge the friction pads 28 outwards and against the inner surface 30. This outward urging of the spring 50 may maintain the outward thrust of the friction pads 28 against the inner surface 30 at a predetermined minimum amount of outward thrust. In turn, this predetermined minimum amount of outward thrust acts to "pre-load" the friction pads 28 against the inner surface 30. In addition, the elastic properties or the spring 50 may offset thinning of the friction pads 28 due to abrasion, for example.

Figure 4:
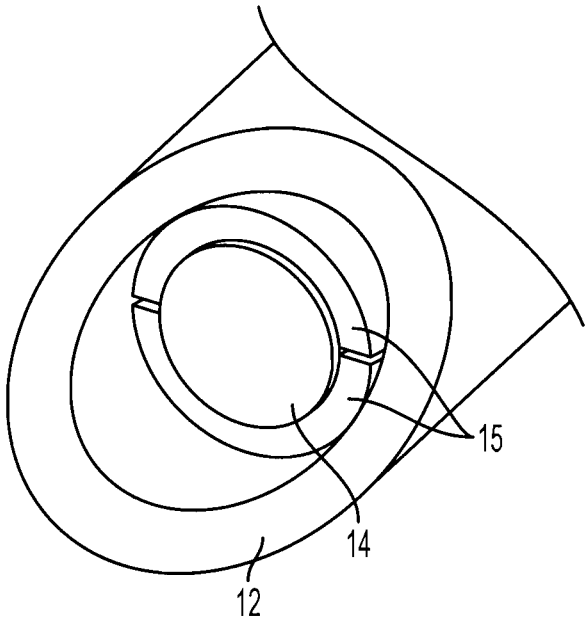
FIG. 4 is a partially cutaway perspective view of the hold open rod shown in FIG. 3.

FIG. 4 is a partially cutaway perspective view of the hold open rod 12 shown in FIG. 1. As shown in FIG. 4, the friction pads 28 may include two complimentary halves 15 which encase the outer surface 14 of the inner tube 16. In response to these complimentary halves of the friction pads 28 being urged apart and against the inner surface 30, the resistance to the sliding motion of the inner tube 16 relative to the outer tube 18 may be increased. In this manner, the hold open rod 12 may be used to control the rate at which the door 10 opens and/or closes.

Figure 5:
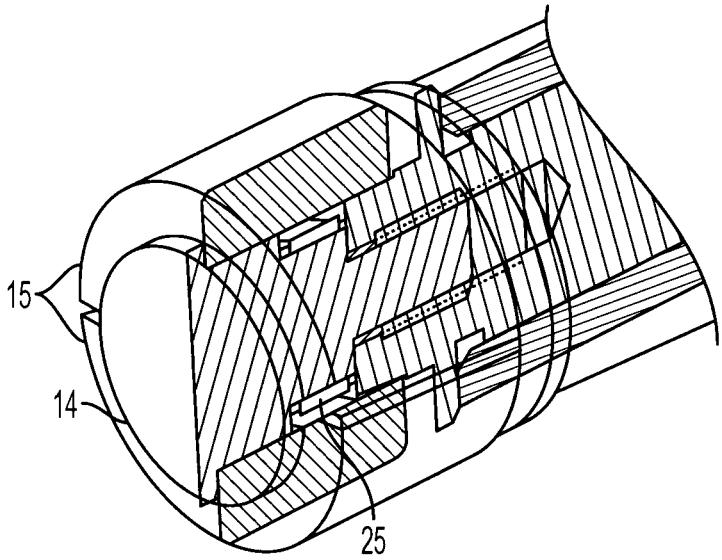
FIG. 5 is a cross-sectional perspective view of the cross-section of the hold open rod shown in FIG. 3.

FIG. 5 is a cross-sectional perspective view of the mechanical dampening device shown in FIG. 3. The shape and material of the friction pads 28 and tube head 40 control the coefficient of friction and therefore, control the dampening feature of the hold open rod 12. The friction pads 28 may be shaped to complement the outer surface of the head 40 such that the desired dampening occurs and may include pad seats 25. As appreciated by one of ordinary skill in the art, the friction pads 28 may be made of an elastomeric material, such as ethylene vinyl acetate, for example.

Figure 6:
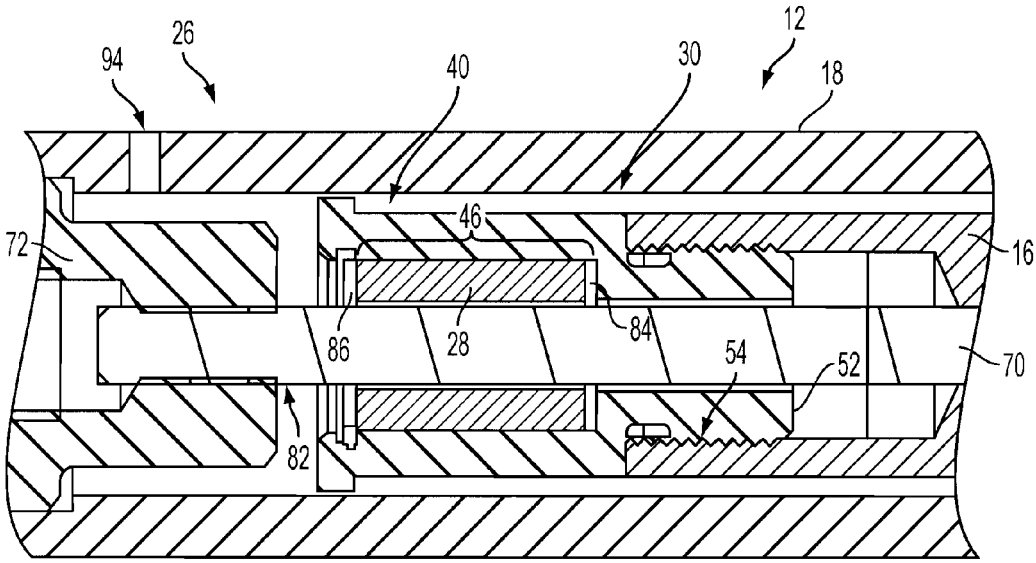
FIG. 6 is a cross-sectional view of a hold open rod according to another embodiment of the invention.

FIG. 6 is a cross-sectional view illustrating hold open rod 12 according to another embodiment. In this embodiment, hold open rod 12 includes an outer tube 18, an inner tube 16 and an inner rod 70. The inner rod 70 is secured to the outer tube 18 via a adapter 72. Specifically, the proximal end of the inner rod 70 is secured in the adapter 72 and the adapter 72 is secured at or near the proximal end of the outer tube 18.

In use, the outer tube 18 and inner rod 70 move in unison and the inner tube 16 telescopes between them. In a manner similar to the embodiment shown in FIG. 3, movement of the inner tube 16 relative to the outer tube 18 generates a transverse load on the friction pad 28 or otherwise compresses the friction pad 28 which increases frictional resistance. In the embodiment shown in FIG. 6, the inner rod 70 is tapered at least at one end, such that as the friction pad 28 is drawn along the inner rod 70, the increasing diameter of the inner rod 70 urges the friction pad 28 radially outwards.

As further shown in FIG. 6, the friction pad 28 is captured between the inner rod 70 and the pad seat 46 of head 40. As such, as the friction pad 28 is translated along inner rod 70 and driven outwardly, the friction pad 28 is compressed between the pad seat 46 and an outer rod surface 82.

To retain the friction pad 28 within the head 40, in one embodiment, a pad seat 46 includes a seat land 84 and a retaining ring 86. To retain the head 40 at the proximal end of the inner tube 16, the head 40 and the inner tube 16 may include a threaded region 54 to connect the head 40 and the inner tube 16. Also shown in FIG. 6, the outer tube 18 may include one or more ports 94 to allow for the ingress and/or egress of air. If included, these ports 94 may reduce or prevent the generation of a partial vacuum or pressurized air that may interfere with the operation of the hold open rod 12. In addition, the ports 94 may facilitate the egress of condensate.

Figure 7:
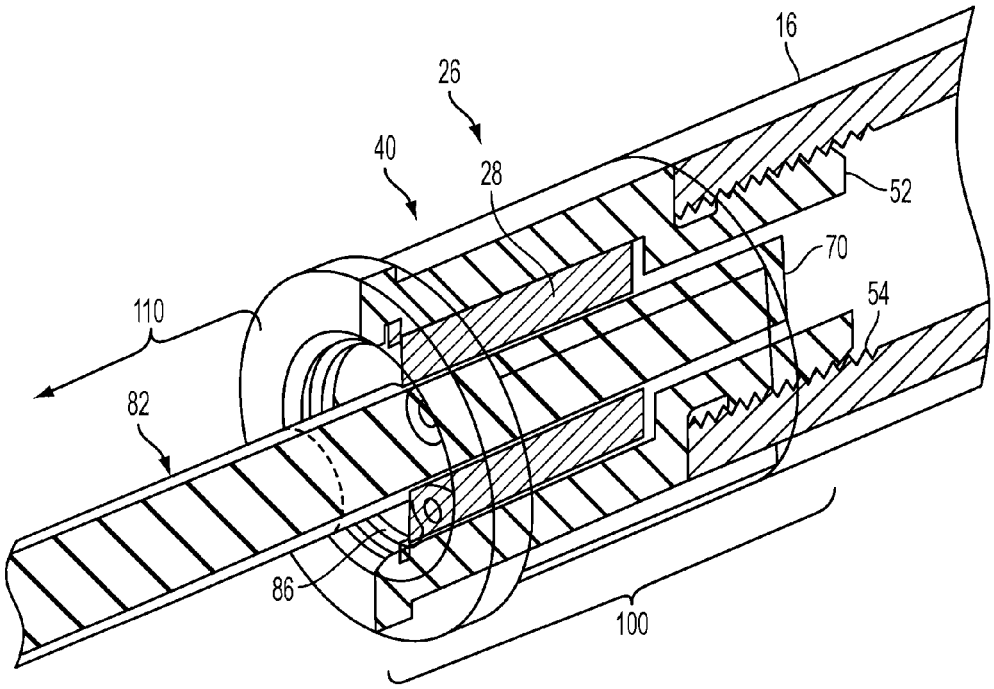
FIG. 7 is a cross-sectional perspective view of the hold open rod according to the embodiment depicted in FIG. 6.

FIG. 7 is a cross-sectional perspective view of the hold open rod 12 at the distal end of the inner rod 70. For the sake of clarity, the outer tube 18 has been removed. As shown in FIG. 7, the distal end of the inner rod 70 may also be tapered at region 100. The tapered region 100 may facilitate retaining the hold open rod 12 in an open or extended configuration. At region 110, the inner rod 70 may be relatively straight sided. In this manner, frictional resistance generated by friction pads 28 may remain relatively constant through some portion of the travel. The tapered region 100 confers several advantages; for example, tapered region 100 facilitates assembly because an outer diameter of the inner rod 70 at the distal end is less than an inner diameter of the friction pads 28. Another advantage is that initial frictional resistance may be reduced to facilitate ease of closing the door 10 (shown in FIGS. 1 and 2). That is, at a fully extended configuration, the reduced diameter of the inner rod 70 may exert relatively less frictional resistance as compared to the frictional resistance as the hold open rod 12 is retracted. If the frictional resistance is insufficient to hold the door 10 against the bias of the door 10, the door 10 may continue to close until the bias and the frictional resistance are in equilibrium. From this state of equilibrium, a relatively small amount of closing force will initiate closing the door 10. Another advantage is that an operational state of the hold open rod 12 may be determined based upon the point in the swing of the door 10 at which the state of equilibrium occurs. For example, if the friction pads 28 lose some thickness due to wear, the state of equilibrium may occur further from the distal end of the inner rod 70. As such, the state of operation of the hold open rod 12 may be readily determined by personnel without the need of testing equipment.

Figure 8:
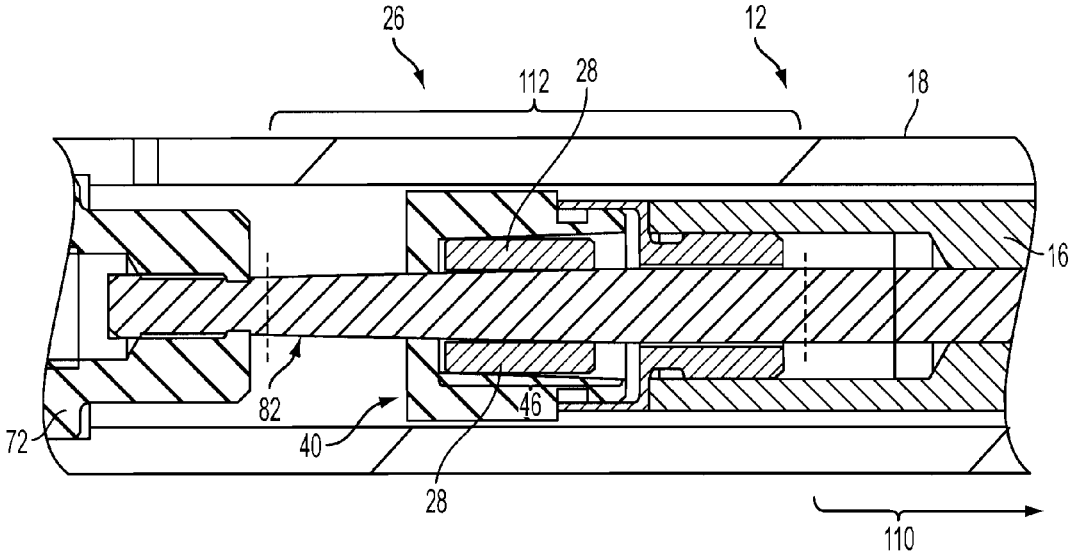
FIG. 8 is a cross-sectional view of a hold open rod according to another embodiment of the invention.

FIG. 8 is a cross-sectional view of the hold open rod 12 according to another embodiment of the invention. As shown in FIG. 8, the friction pads 28 provides frictional resistance to extension of the hold open rod 12 and relatively less frictional resistance to retraction of the hold open rod 12. To generate this frictional resistance, the pad seat 46 is frusta-conical; compression of the friction pads 28 occurs during extension of the hold open rod 12.

Figure 9:
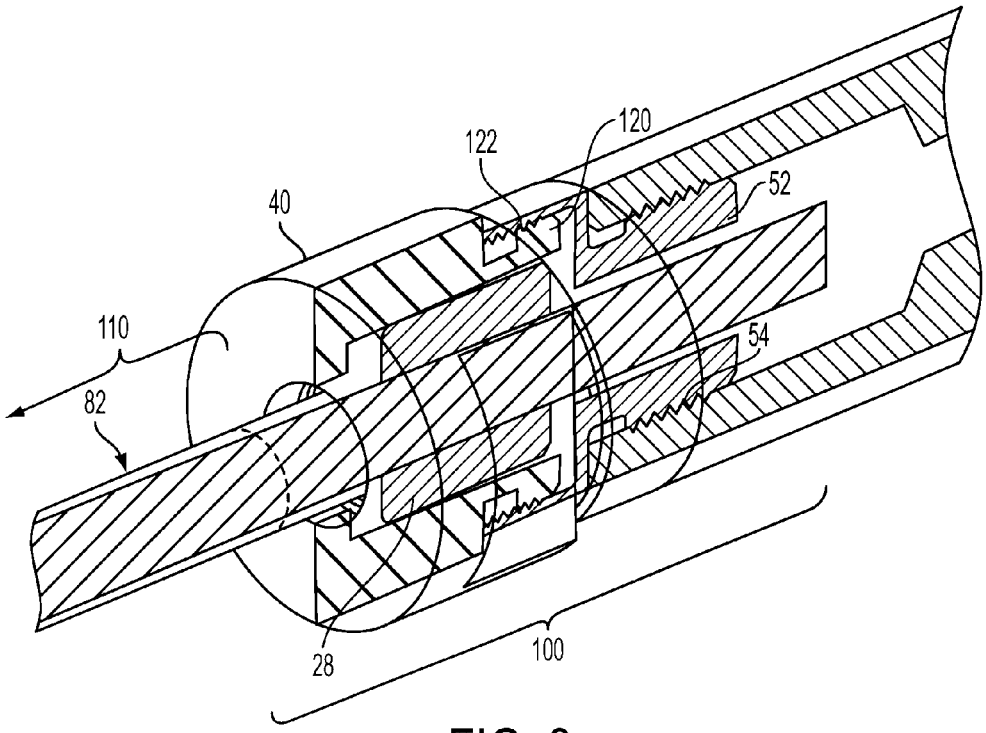
FIG. 9 is a cross-sectional perspective view of the hold open rod according to the embodiment depicted in FIG. 8.

FIG. 9 is a cross-sectional perspective view of the hold open rod 12 depicted in FIG. 8. Threaded region 120 mates with tapped bore 122, thereby facilitating disassembly, servicing or replacing the friction pads 28, and re-assembly. In this and other embodiments, the head 40 includes retaining ring 86 (shown in FIG. 7), set screw, or the like to facilitate servicing the friction pads 28.

Figure 10:
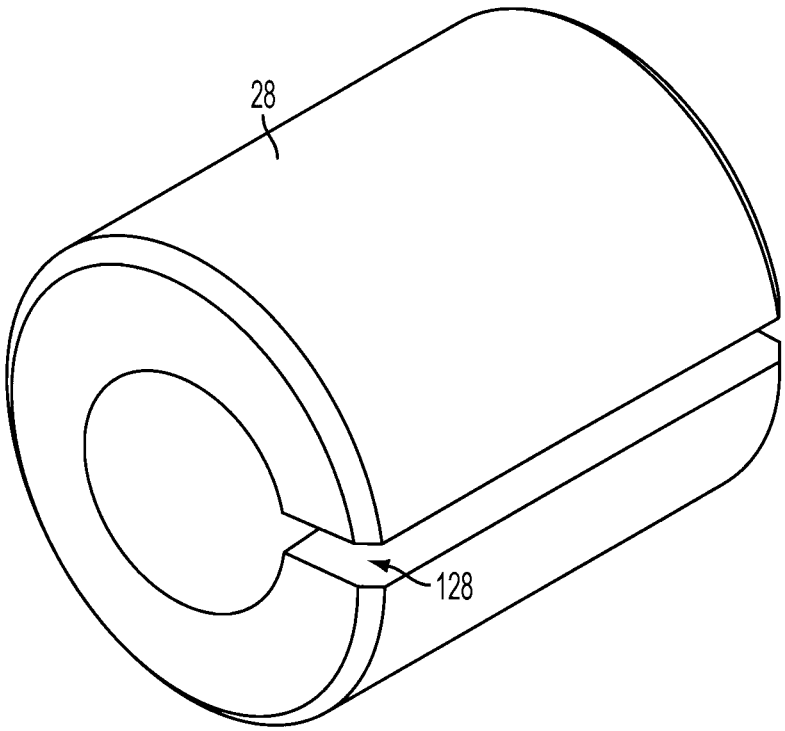
FIG. 10 is a perspective view of a friction pad according to an embodiment of the invention.

FIG. 10 is a perspective view of the friction pad of the hold open rod 12 according to an embodiment of the invention. As shown in FIG. 10, friction pads 28 may be a single friction pad. In the embodiment shown in FIG. 10, the friction pad 28 may include a slit 128 to accommodate expansion/contraction of the pad seat 46/inner rod 70.

Figure 11:
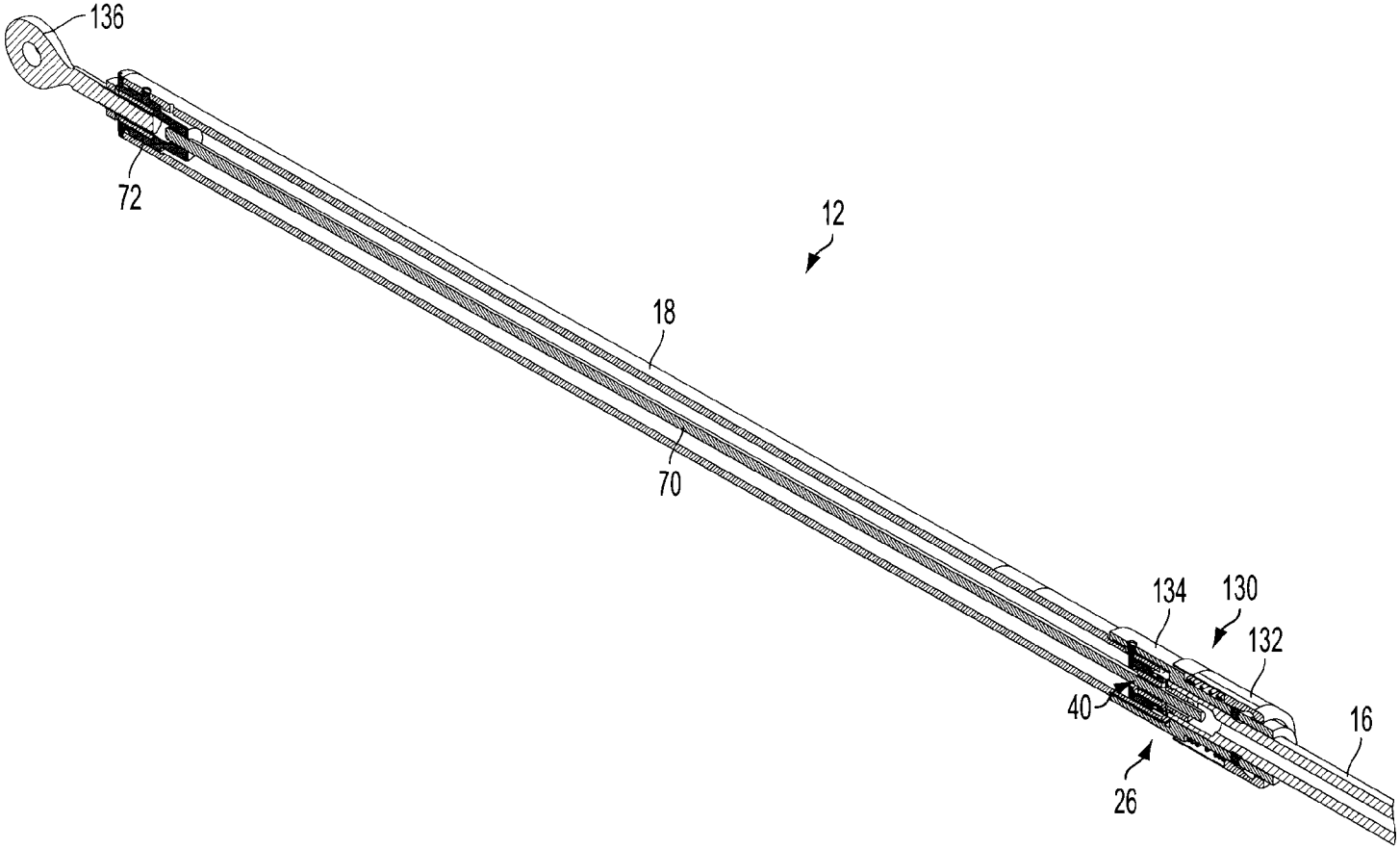
FIG. 11 is an isometric cross-sectional view of the hold open rod according to an embodiment of the invention.

FIG. 11 is an isometric cross-sectional view of the hold open rod 12 according to an embodiment of the invention. Hold open rod 12 includes a release assembly 130 including a release collar 132 and lock body 134, and a fitting 136 to secure the hold open rod 12 to bracket 22. In various embodiments, fitting 136, such as an eye bolt or the like, may be threaded, press fit, or otherwise secured to the adapter 72.

Figure 12:
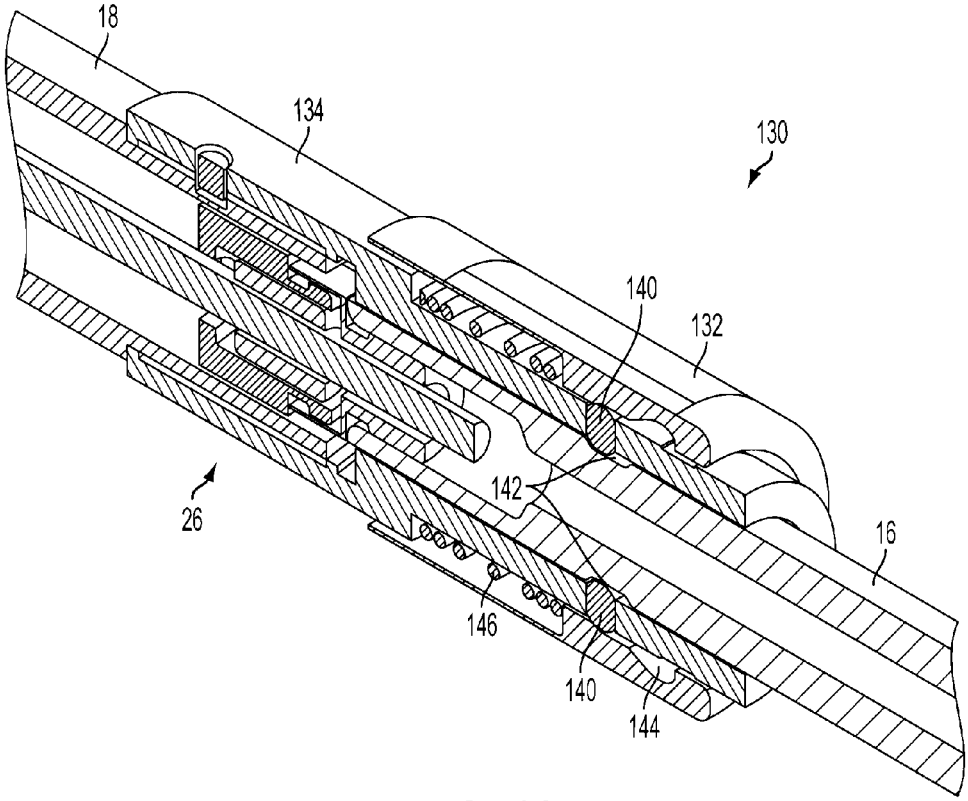
FIG. 12 is an isometric cross-sectional view of a release assembly according to the embodiment depicted in FIG. 11.

FIG. 12 is an isometric cross-sectional view of the release assembly 130 according to the embodiment shown in FIG. 11. When disposed in a 'locked configuration', the release collar 132 retains one or more locking dogs 140 into a dog groove 142. The dog groove 142 is disposed about the inner tube 16. The release collar 132 further includes a release groove 144. In response to the release collar 132 being in an 'unlocked configuration' the release groove 144 is disposed cooperative alignment with the locking dogs 140 to allow the locking dogs 140 to slide out of the dog groove 142. In this manner, the inner tube 16 is allowed to retract into the outer tube 18. To bias the release collar 132 in the locked configuration, the release assembly 130 may include a spring 146. To release the release assembly 130, the release collar 132 is urged to slide relative to the lock body 134 against the bias of the spring 146. While in the release configuration, the inner tube 16 may be allowed to slide relative to the outer tube 18.

Figure 13:
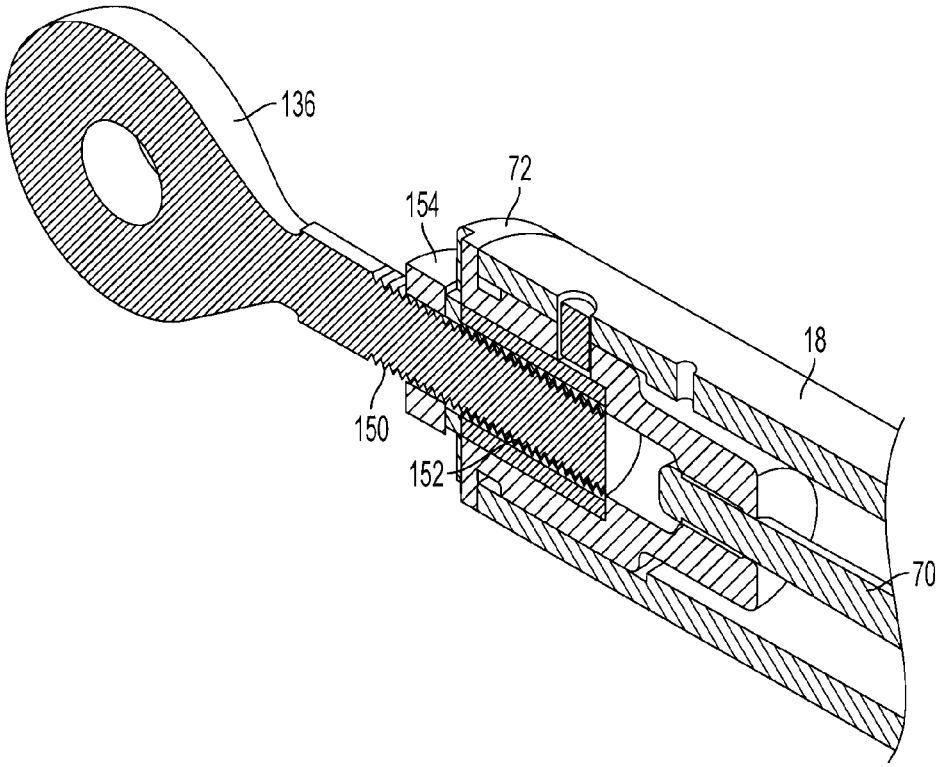
FIG. 13 is an isometric cross-sectional view of an end fitting suitable for attachment to a proximal end of the hold open rod.

FIG. 13 is an isometric cross-sectional view of an end fitting suitable for attachment to a proximal end of the hold open rod 12. Fitting 136 is secured in the adapter 72. In various examples, fitting 136 may include any suitable end fitting for attachment to the door 10 or a frame of the door 10. Examples of suitable end fittings include eye bolts, rod end bearings, universal joints, clevis pins, and the like. Fitting 136 may be secured to the adapter 72 in any suitable manner. For example, fitting 136 may be threaded into a tapped bore, press fit, locked via a set screw, and/or the like. In the particular example shown, the fitting 136 includes a threaded region 150 to mate with a tapped bore 152. To further secure the fitting 136 in the adapter 72, a locking nut 154 may be utilized.

Figure 14:
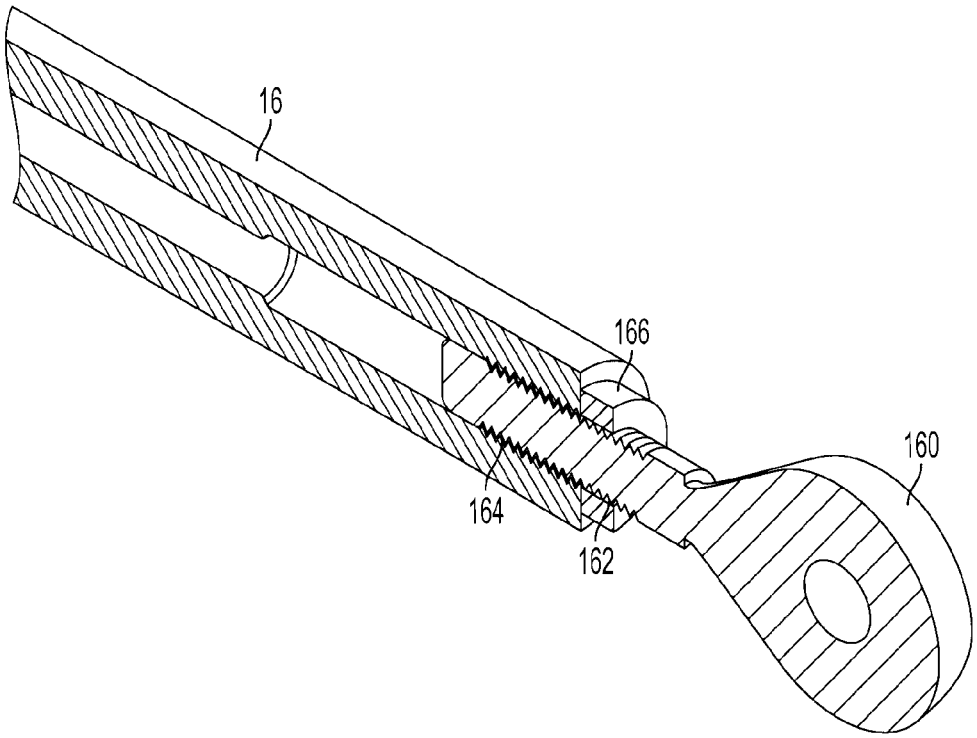
FIG. 14 is an isometric cross-sectional view of an end fitting suitable for attachment to a distal end of the hold open rod.

FIG. 14 is an isometric cross-sectional view of an end fitting suitable for attachment to a distal end of the hold open rod 12. As shown in FIG. 14, fitting 160 is secured to the distal end of the inner tube 16. In various examples, the fitting 160 may include any suitable end fitting for attachment to the door 10 or a frame of the door 10. Examples of suitable end fittings include eye bolts, rod end bearings, universal joints, clevis pins, and the like. The fitting 160 may be secured to the inner tube 16 in any suitable manner. For example, the fitting 160 may be threaded into a tapped bore, press fit, locked via a set screw, and/or the like. In the particular example shown, the fitting 160 includes a threaded region 162 to mate with a tapped bore 164. To further secure the fitting 160 in the inner tube 16, a locking nut 166 may be utilized.

Figure 15:
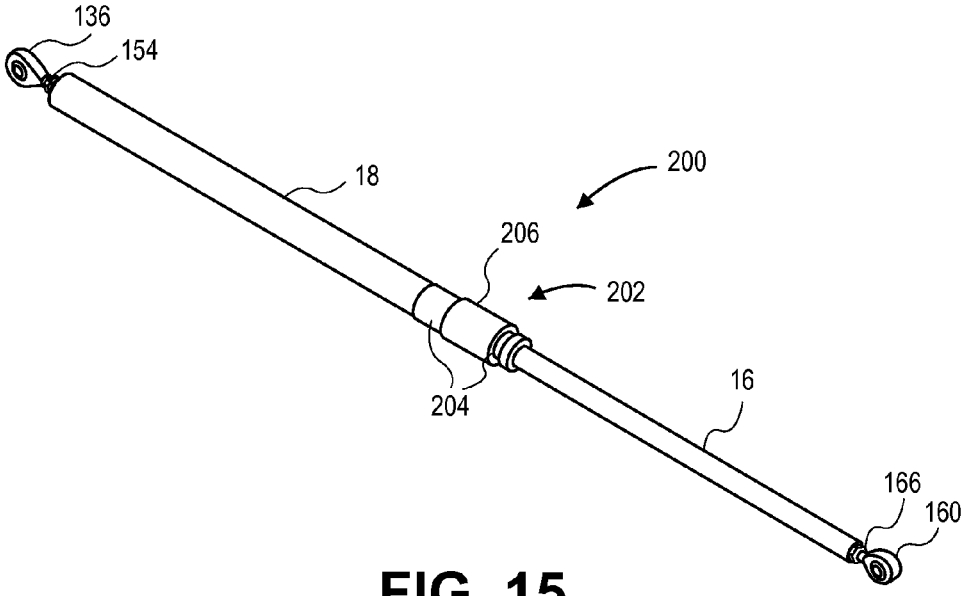
FIG. 15 is an isometric view of a hold open rod in an extended position.
Figure 16:
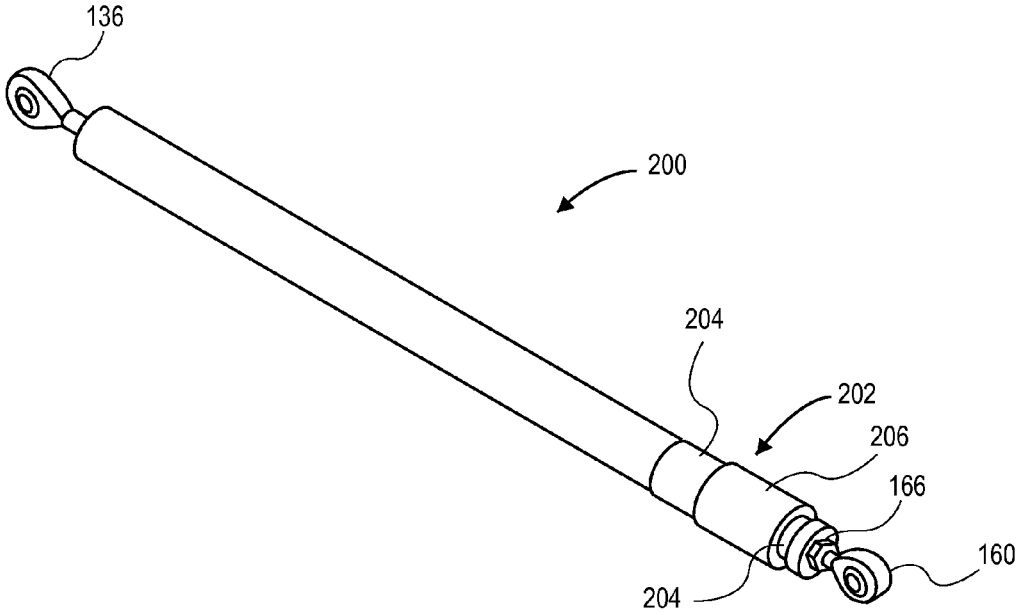
FIG. 16 is an isometic view of a hold open rod in a retracted position.

FIGS. 15 and 16 are perspective views of a hold open rod 200 in accordance with other embodiments of the invention. FIG. 15 shows a hold open rod 200 in an extended position. FIG. 16 shows the hold open rod 200 in a retracted position. With reference to both FIGS. 15 and 16, the hold open rod 200 has an inner tube 16 and outer tube 18. A fitting 136 is located on the outer tube 18. A locking nut 154 helps to secure the fitting 160 to the outer tube 18. The inner tube 16 also contains a fitting 160. A locking nut 166 helps to attach the fitting 136 onto the inner tube 16. The inner tube 16 and outer tube 18 fittings 136, 160 and locking nuts 154 and 166 are similar to those described above. One difference between the hold open rod showed in the earlier Figures and the hold open rod 200 of FIGS. 15 and 16 is that the hold open rod 200 of FIGS. 15 and 16 include the hold open assembly 202.

Figure 17:
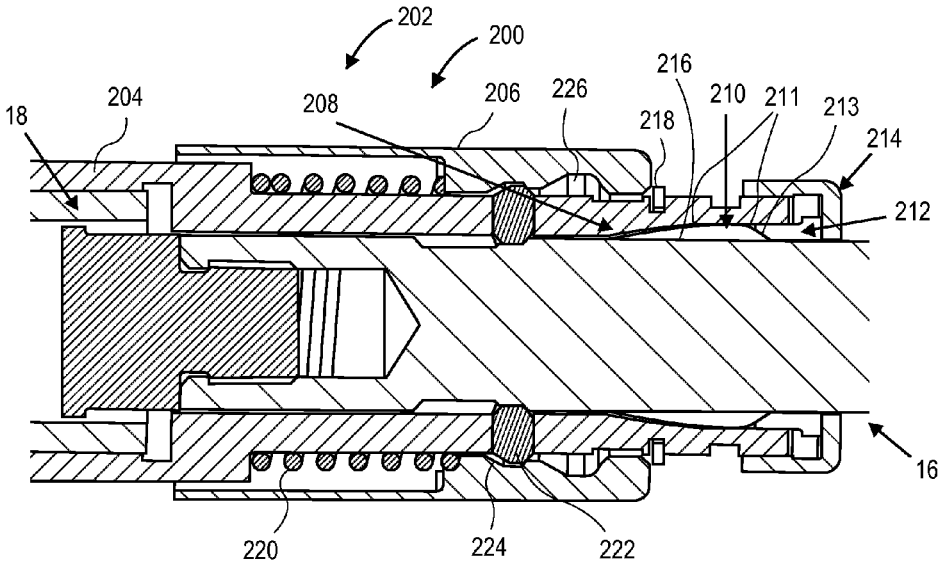
FIG. 17 is a cross-sectional view of hold open assembly in accordance with an embodiment of the invention.
Figure 19:
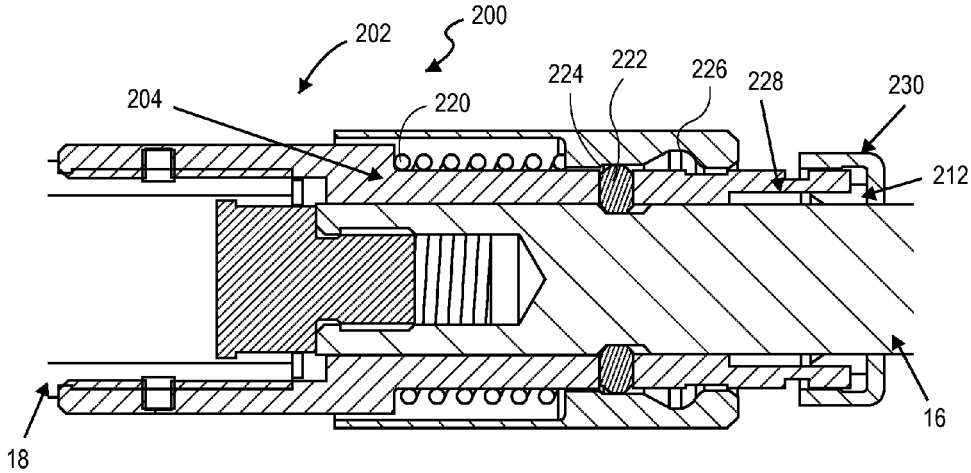
FIG. 19 is a cross-sectional view of hold open assembly in accordance with another embodiment of the invention.
Figure 18:
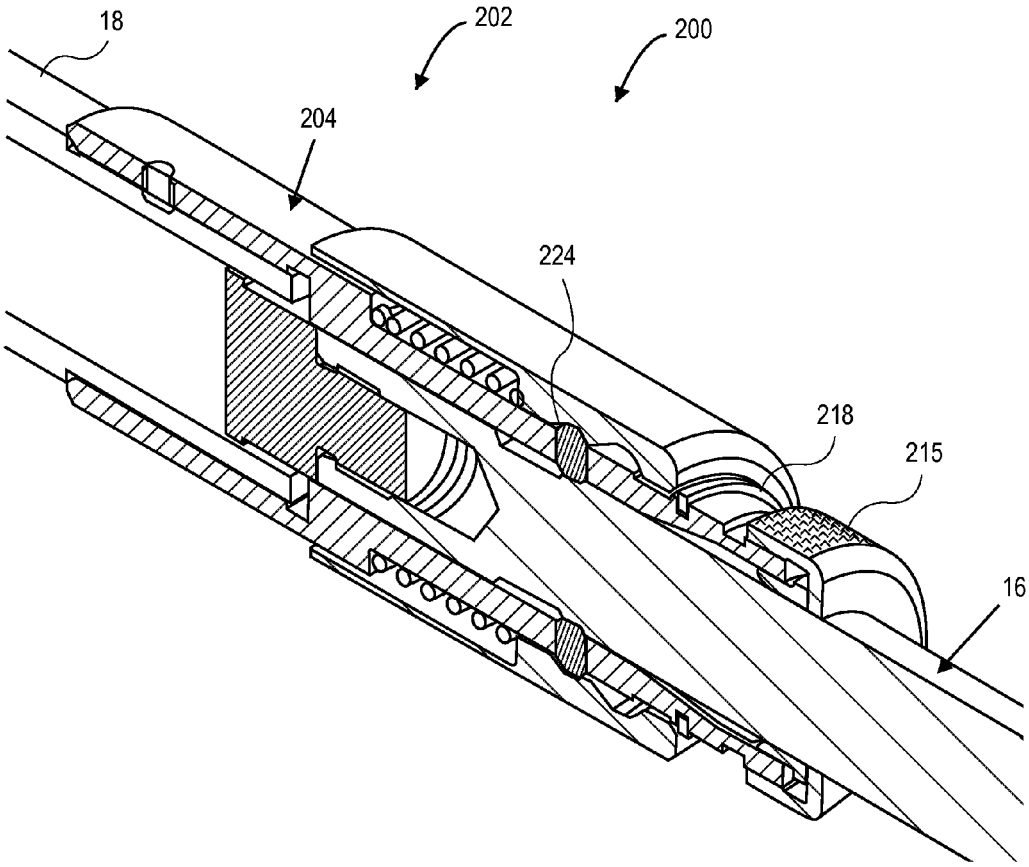
FIG. 18. is an isometric cross-sectional view of the hold open assembly shown in FIG. 17.
Figure 20:
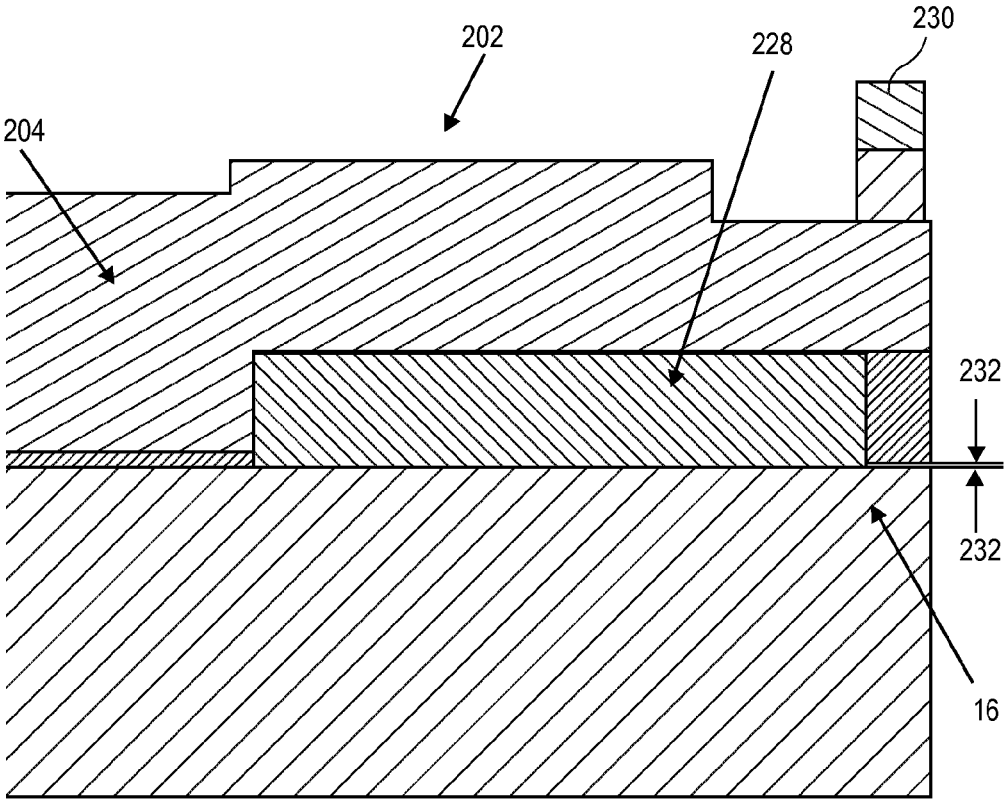
FIG. 20 is a detailed partial view of the hold open assembly shown in FIG. 19.

FIGS. 17 and 18 illustrate a hold open assembly 202 in accordance with another embodiment of the invention. FIGS. 19 and 20 illustrate a hold open assembly 202 in accordance with yet another embodiment of the invention. The hold open assembly 202 shown in FIGS. 17 through 20 are similar and will be described in turn. Like reference numerals shown in the embodiment shown in FIGS. 17 through 20 refer to like or similar parts.

The embodiment shown in FIGS. 17 and 18 will now be described. The outer tube 18 has a lock body 204 attached to the outer tube 18. A release collar 206 covers the lock body 204. The release collar 206 is movable between a lock position and an unlock position. The position shown in FIGS. 17 through 20 show the release collar 206 in the lock position. When the release collar 206 is in the lock position the hold open assembly 202 is configured to not allow the inner tube 16 to slide within the outer tube 18. When the release collar 206 is moved axially to an unlock position, the inner tube 16 may slide within outer tube 18.

The release collar 206 contains a dog groove 224. A locking dog 222 sits within the lock body 204 and the dog groove 224. When the release collar 206 is moved to towards the unlock position, the spring 220 is compressed and the release groove 226 is aligned with the lock dog 222. The lock dog 222 is then allowed to expand into the release groove 226, thereby unlocking the inner tube 16 to the outer tube 18 and allow the inner tube 16 and outer tube 18 to slide with respect to each other in a telescoping manner.

The spring 220 is captured between the release collar 206 and the lock body 204. The release collar 206 is biased by the spring 220 into the locking position. According to the embodiment shown in FIGS. 17 and 18, a retaining ring is used to prevent the release collar 206 from sliding off of the lock body 204. The retaining ring 218 may be removed or flexed when the rod 200 is serviced or maintained and not during normal operations Other embodiments, such is that shown in FIGS. 19 and 20, do not have a retaining ring 218.

The lock body 204 and the inner tube 16 trap a dampening pad 210. the dampening pad 210 may be made of elastomeric material such as ethylene vinyl acetate, for example. Other materials for the dampening pad 210 may be used. According to some embodiments of the invention, one purpose of the dampening pad 210 is to provide friction as the inner tube 16 slides past the outer tube 18 and the lock body 204.

In some embodiments of the invention, the outer diameter or outer surface 216 of the inner tube 16 may be tapered so that the friction force created by the adjustable dampening pad 210 increases at selected positions along the inner tube 16. As shown in FIGS. 17 and 18, the lock body 204 may also have a tapered surface 208. The dampening pad 210 may also have a corresponding tapered surface 211 corresponding to the tapered surface 208 on the lock body 204. The tapers on the outer surface 216 of the inner tube 16 and the tapered surface 208 on the lock body 204 may be selected to increase the friction between the inner tube 16 and the outer tube 18 and/or lock body 204 as the hold open rod 200 achieves an extended position as shown in FIG. 15. In some embodiments of the invention the surfaces 216 and/or 208 maybe be frustaconical shaped, and, in other embodiments, the surfaces 216 and 208 may be tapered.

According to some of the embodiments of the invention the amount of frictional force applied by the dampening pad 210 may be adjusted. For example, an adjustor 214 may be threadably attached to the lock body 204. As shown in FIGS. 17 and 18 the adjustor 214 is threadably attached to the lock body 204. The adjustor 214 has a knurled surface 215 as shown in FIG. 18, for example, and is turned by a user. By turning the adjustor 214, the threads on the adjustor 214 interact with corresponding threads on the lock body 204 to move the adjustor 214 along the lock body 204. Moving the adjustor 214 causes the spacer 212 to move and compress or move the dampening pad 210. By compressing and moving the dampening pad 210, the dampening pad 210 will increase the amount of friction force exerted on the outer surface 216 of the inner tube 16 and the surface 208 on the lock body 204. Therefore, a user may advantageously adjust the amount of friction or resistance the hold open rod 12 has by turning the adjustor 214.

The embodiments shown in FIGS. 19 and 20 are similar to that shown and described above with respect to FIGS. 17 and 18, as noted above. For example, as shown in FIGS. 19 and 20, an inner tube 16 and outer tube 18 are fit together in a telescoping manner. The outer tube 18 is equipped with a lock body 204. The lock body 204 and the inner tube 16 trap a dampening pad 228. The dampening pad 228 maybe made of similar materials as described above with respect to damping pad 210 of FIGS. 17 and 18. However, the dampening pad 228 may not have the tapered surface 211 as shown in FIGS. 17 and 18.

The release collar 206 may be moved against the urging of the spring 220 to the release position where the locking dog 222 moves from the dog groove 224 to the release groove 226 and expands to fill the release groove 226. This movement of the locking dog 222 permits the inner tube 16 to be moved within the outer tube 18. As discussed above, in some embodiments the tension or friction exerted by the dampening pad 210 (or 228) on the inner tube 16 and the lock body 204 may be adjusted by turning the end cap 230 (or 214) which, in turn, moves the spacer 212 to compress the dampening pad 210 (or 220), as described above. In other embodiments, the end cap 230 or 214 is not adjustably engaged with the lock body 204, but rather is fixed in place. In such an arrangement, the end cap 214 or 230 is fixed and can not adjustably import compressive force on the dampening pad 210 (or 228).

FIG. 20 is a close-up partial view of part of the hold open assembly 202. The inner tube 16 and the lock body 204 are shown entrapping the dampening pad 228. In some embodiments the inner tube 16 is tapered. The lines 232 illustrate a gap showing an amount of reduction in diameter of the inner tube 16 resulting from the taper along the length of the inner tube 16. The amount of the reduction maybe selected to achieve the amount of dampening force desired at various points along the length of the inner tube 16.

Figure 21:
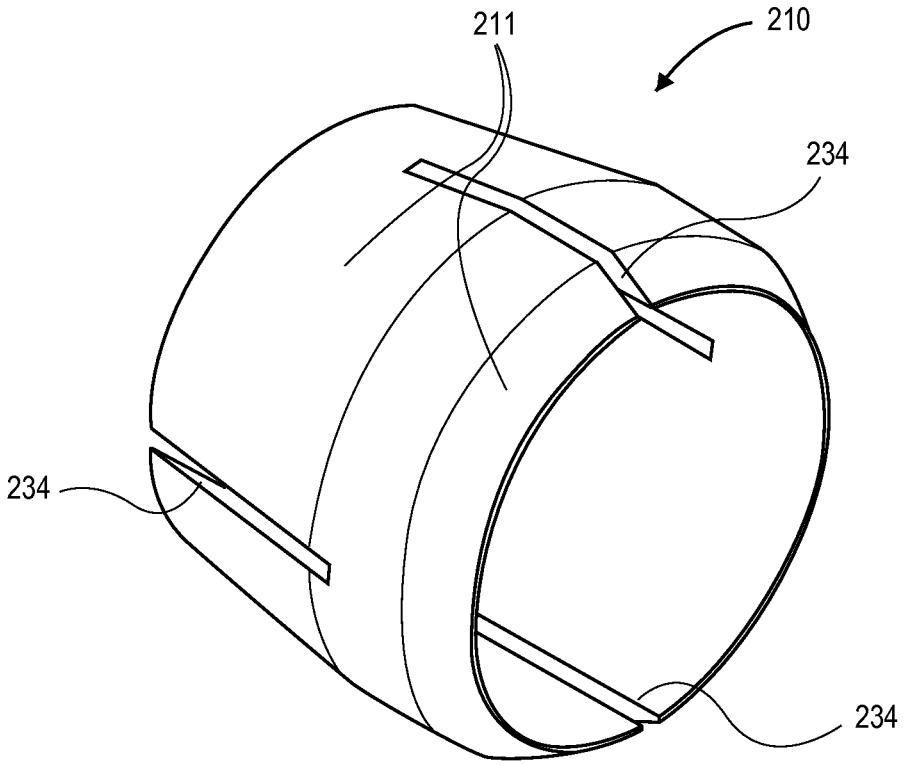
FIG. 21 is an isometric view of damping pad in accordance with an embodiment of the invention.

FIG. 21 is an isometric view of a tapered dampening pad 210, which has tapered surfaces 211 in accordance with the embodiment shown in FIGS. 17 and 18. In one embodiment, the tapered dampening pad 210 may also have relief grooves 234, which aid in allowing the dampening pad 210 to be compressed.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A hold open rod, comprising:

an outer tube;

a lock body connected to the outer tube;

an inner tube, slidingly disposed within the outer tube and lock body, including an outer surface; and a friction pad captured between the lock body and the outer surface of the inner tube;

a release assembly operable between a locked position, in which the inner tube is movable within the outer tube but cannot be separated from the outer tube, and an unlocked position in which the inner tube is configured be separated from the outer tube;

wherein:

the release assembly includes a release collar having a dog groove and a release groove, the lock body includes a locking dog, and the locking dog engages the dog groove in the locked position and the release groove in the unlocked position; and a spring urging the release collar to the locking position.

2. The hold open rod according to claim 1, wherein at least one of the outer surface of the inner tube and an inner surface of the lock body form at least one tapered surface to affect a friction load developed by the friction pad between the lock body and the inner tube; the at least one tapered surface configured to allow the friction load to be adjusted for a set damping load or to be periodically adjusted; and the at least one tapered surface one of removes and engages a set resistance depending on the inner tube location relative to the lock body.

3. The hold open rod according to claim 2, wherein the at least one tapered surface the lock body comprises a frustaconical shape.

4. The hold open rod according to claim 1, wherein the friction pad is an elastomeric material.

5. The hold open rod according to claim 1, further comprising a cap, adjustably mounted to the lock body, and configured to move with respect to the lock body, to move the friction pad to impart an amount of friction force the friction pad exercises on at least one of the inner tube and the lock body.

6. The hold open rod according to claim 5, wherein the cap moves the friction pad via a spacer.

7. The hold open rod according to claim 5, wherein the cap is engaged to the lock body with threads.

8. The hold open rod according to claim 1, wherein the lock body is removably attached to the outer tube.

9. The hold open rod according to claim 1, wherein the hold open rod is attached to a portion of an aircraft.

* * * * *